US009156531B2

(12) United States Patent
Schweighardt et al.

(10) Patent No.: US 9,156,531 B2
(45) Date of Patent: Oct. 13, 2015

(54) TANK STORAGE DEVICE

(71) Applicants: Stephen Schweighardt, Jupiter, FL (US); Simon Schweighardt, North Palm Beach, FL (US)

(72) Inventors: Stephen Schweighardt, Jupiter, FL (US); Simon Schweighardt, North Palm Beach, FL (US)

( * ) Notice: Subject to any disclaimer, the term of this patent is extended or adjusted under 35 U.S.C. 154(b) by 0 days.

(21) Appl. No.: 13/841,030

(22) Filed: Mar. 15, 2013

(65) Prior Publication Data

US 2014/0262913 A1 Sep. 18, 2014

(51) Int. Cl.
*B65D 85/00* (2006.01)
*B63C 11/02* (2006.01)

(52) U.S. Cl.
CPC ..... *B63C 11/02* (2013.01)

(58) Field of Classification Search
CPC .... B65D 1/3881; B65D 1/3893; B65D 1/052; B65D 81/02; Y10S 220/903; B62B 1/16; B65F 1/068; A47G 23/0216; B63C 11/02
USPC ..... 206/522; 224/406, 315, 42.33, 540, 224/566, 569; 114/345; 441/40
See application file for complete search history.

(56) References Cited

U.S. PATENT DOCUMENTS 3,602,386 A * 8/1971 Brime ..... 215/12.1
4,681,219 A 7/1987 Kitchens
4,871,099 A 10/1989 Bogar, Jr.
4,964,183 A * 10/1990 LaForce, Jr. ..... 5/421
5,025,935 A 6/1991 Hadachek
5,163,579 A * 11/1992 Jones ..... 220/629
5,299,721 A 4/1994 Cummings
5,524,564 A 6/1996 Porada
5,546,885 A 8/1996 Porada
5,969,592 A * 10/1999 Reed ..... 340/384.1
6,250,467 B1 * 6/2001 Weder ..... 206/423
6,341,475 B2 * 1/2002 Weder ..... 53/472
6,405,882 B1 6/2002 Baxter
7,028,962 B1 4/2006 Hostetler
7,107,641 B2 * 9/2006 Davis ..... 5/710
7,150,123 B1 12/2006 Fox
7,341,377 B1 3/2008 Baxter
7,376,995 B2 * 5/2008 Davis ..... 5/710
7,565,709 B2 * 7/2009 Davis ..... 5/710
7,658,267 B1 2/2010 Welsh
2003/0015448 A1 * 1/2003 Weder ..... 206/423
2006/0219723 A1 * 10/2006 Wang ..... 220/592.27
2007/0053615 A1 * 3/2007 Liu et al. ..... 383/3
2008/0093244 A1 * 4/2008 Binah et al. ..... 206/433

* cited by examiner

*Primary Examiner* — Anthony Stashick
*Assistant Examiner* — James M Van Buskirk
(74) *Attorney, Agent, or Firm* — Simpson & Simpson, PLLC

(57) ABSTRACT

The invention is a device for holding dive tanks having at least one inflation valve, a top wall including a plurality of top openings, a bottom wall, a plurality of side walls connecting the top and bottom walls, at least one chamber partially enclosed by the top, bottom, and side walls, and a plurality of sleeves. Each sleeve includes a respective top end bounded by a respective top opening, a respective bottom end, and a respective body connecting the top and bottom ends and forming a respective space partially enclosed by the respective body. The inflation valve is arranged to introduce into the one chamber a medium to inflate the device. When the device is inflated, the respective space is arranged to receive and hold a respective dive tank, and the respective bottom end is arranged to support the respective dive tank.

20 Claims, 10 Drawing Sheets

TANK STORAGE DEVICE

FIELD OF THE INVENTION

The present invention broadly relates to a storage device for dive tanks, and, more particularly, to an inflatable storage device operatively arranged to be expandable in order to hold dive tanks but also collapsible for compact, easy storage.

BACKGROUND OF THE INVENTION

A dive tank, also referred to as a diving cylinder or scuba tank, is a gas cylinder used to store and transport high pressure breathing gas primarily used while scuba diving. Because dive tanks contain pressurized air, they can be hazardous if not stored properly or if mishandled during transport. Therefore, it is preferable that dive tanks are stored in a substantially upright position as opposed to a horizontal position. Furthermore, since dive tanks act as a life support means while a diver is underwater, extra precautions should be taken to prevent damage, marring, and scratches to the tanks, which can eventually lead to corrosion. Nevertheless, dive tanks are often times left on the deck of a boat, loose and unsecured.

Storage devices used to store and transport dive tanks are well known. Dive tanks typically have an internal volume of between 0.11 and 0.64 cubic feet. The base of the tank typically ranges in diameter between 3 to 8 inches and the height typically varies between 10 to 30 inches, with the most common size tank having approximately a 7.25-inch base and approximately a 25- to 26-inch height. A problem with prior tank storage devices is that they are generally hard and rigid, which can present several problems. First, the rigidity of the storage device limits the size of the dive tanks that can be accommodated. Second, they can be bulky and cumbersome to transport, and when not in use, they take up valuable space on the deck of a boat. Third, hard and rigid tank storage devices can pose a safety hazard on a boat.

One tank storage device, found in U.S. Pat. No. 6,405,882 (Baxter), includes a plurality of molded cylinders, made from plastic, resin, fiberglass, etc., and a frame. Each cylinder has a bottom surface, a top surface, and a throughbore that extends from the top surface to slightly above the bottom surface. As mentioned above, a disadvantage of this type of tank storage device is that it is made of a hard, rigid material, which limits the size of tanks that can be held. Additionally, the hard material can scratch the surface of the tanks, causing them to corrode. Furthermore, the hard material can also present a safety hazard for divers on a boat because the hard material can cause injury to a diver if a diver abuts against the device or if the device topples over onto the diver. A further disadvantage is that the reference device does not collapse; and therefore, it would be large and difficult to store when not in use, taking up already limited space on a boat.

Another tank storage device, shown in U.S. Pat. No. 5,299,721 (Cummings), comprises a receptacle, a cover covering the receptacle interior and having holes for receiving scuba tanks, and lock plates adjustably and slidably mounted on side walls of the receptacle that engage with the boat. The reference tank storage device is made from plastic, wood, metal, etc. As mentioned above, a disadvantage of this type of tank storage device is that it is made of a hard, rigid material, which limits the size of tanks that can be held, and because it does not collapse, it would be large and difficult to store when not in use. Furthermore, it is not portable, as permanent hardware mounted to the boat is required to secure and stabilize the device.

U.S. Pat. No. 7,341,377 (Baxter) discloses a container bag for storing cylindrical tanks, such as dive tanks, comprising mesh or canvas sides, at least two openings for storing cylindrical tanks, a bottom cover, a lid, and carry handles. Baxter discloses that the tank storage device is made of mesh or canvas siding. Mesh material is generally not durable and can be prone to rips and tears, while many canvas materials are be prone to mold and mildew when exposed to water. Additionally, the mesh or canvas siding offers little protection from the tank surface being scuffed or marred. Furthermore, the mesh or canvas material limits the size of dive tanks that can be accommodated.

Thus, there is a long-felt need for a device that can accommodate various sizes of dive tanks. There is also a long-felt need for a storage device that can expand to hold dive tanks when in use and that can collapse to be compact for easy storage and to conserve space on a boat when not in use. Additionally, there is a long-felt need for a device that is soft and flexible, which not only protects the integrity of the dive tanks while they are being held but also lowers the risk of injury to divers. Furthermore, there is a long-felt need for a dive tank storage device that is durable and resistant to the elements.

BRIEF SUMMARY OF THE INVENTION

According to aspects illustrated herein, there is provided a device for holding at least one dive tank. The device generally has at least one inflation valve, a top wall including at least one top opening, a bottom wall, a plurality of side walls connecting the top and bottom walls, at least one chamber at least partially enclosed by the top, bottom, and side walls, and a plurality of sleeves. Each sleeve includes a respective top end bounded by a respective top opening, a respective bottom end, and a respective body connecting the top and bottom ends and forming a respective space at least partially enclosed by the respective body. The at least one inflation valve is arranged to introduce into the at least one chamber a medium to inflate the device. When the device is inflated the respective space is arranged to receive and hold a respective dive tank, and the respective bottom end is arranged to support the respective dive tank. Moreover, the respective bottom end is integral with the bottom wall and the bottom wall is made of a solid material not capable of inflation with the medium. Preferably, the plurality of sleeves partially encloses the at least one chamber. The respective bottom end is substantially the same size as or smaller than the respective top opening.

In one embodiment, the at least one chamber includes first and second airtight chambers with a common wall connecting the first and second airtight chambers. The at least one inflation valve includes first and second inflation valves for the first and second airtight chambers, respectively. The first airtight chamber includes the top wall, the second airtight chamber includes the bottom wall, and the plurality of sleeves is partially disposed in each of the first and second airtight chambers. Additionally, the first airtight chamber includes a first portion of the plurality of side walls and the second airtight chamber includes a second portion of the plurality of side walls. The first airtight chamber is enclosed by the top wall, the first portion of the plurality of side walls, the common wall, and respective first portions of the plurality of sleeves including the respective top openings. The second airtight chamber is enclosed by the bottom wall, the second portion of the plurality of side walls, the common wall, and respective second portions of the plurality of sleeves including the respective bottom end. Additionally, the bottom end of each sleeve further includes at least one drainage aperture and at least one of the plurality of side walls includes a handle. Furthermore, each sleeve further comprises an insert disposed within the space proximate to the bottom end of each sleeve and the bottom wall includes at least one foot tab extending outwardly therefrom.

Preferably, the device is substantially rectangular in shape and the top opening of each sleeve is substantially oblong or circular in shape. Furthermore, the top opening of each sleeve has a diameter D, wherein diameter D is approximately 24.765 centimeters. The device has a length L, a width W, and a height H. Preferably, the length L is approximately 90 centimeters, the width W is approximately 60 centimeters, and the height H is approximately 50 centimeters. However, it should be appreciated that the device, top openings, and sleeves can vary in size, shape, and configuration. Moreover, the device is preferably made of a polyvinyl chloride (PVC) material, such as an 1,100 decitex PVC material. However, it should be appreciated that the device can be made of any suitable material known in the art.

In another embodiment, the assembly generally includes at least two modules. Each module has at least one inflation valve, a top wall including a plurality of top openings, a bottom wall, a plurality of side walls connecting the top and bottom walls, at least one chamber at least partially enclosed by the top, bottom, and side walls, and a plurality of sleeves. Each sleeve includes a respective top end bounded by a respective top opening, a respective bottom end, and a respective body connecting the top and bottom ends and forming a respective space at least partially enclosed by the respective body. The at least one inflation valve is arranged to introduce into the at least one airtight chamber a medium to inflate the device. When the device is inflated the respective space is arranged to receive and hold a respective dive tank and the respective bottom end is arranged to support the respective dive tank. Moreover, the respective bottom end is integral with the bottom wall and the bottom wall is made of a solid material not capable of inflation with the medium. Furthermore, each module includes a plurality of teeth, where the plurality of teeth is disposed along the surface of at least one side wall, such that when a first module is paired with a second module, the plurality of teeth on each corresponding module interlock to form a zipper.

BRIEF DESCRIPTION OF THE DRAWINGS

The nature and mode of operation of the present invention will now be more fully described in the following detailed description of the invention taken with the accompanying drawing figures, in which.

DETAILED DESCRIPTION OF THE INVENTION

At the outset, it should be appreciated that like drawing numbers on different drawing views identify identical, or functionally similar, structural root elements of the invention. Moreover, although any methods, devices or materials similar or equivalent to those described herein can be used in the practice or testing of these embodiments, some embodiments of methods, devices, and materials are now described.

Furthermore, it is understood that this invention is not limited to the particular methodology, materials and modifications described and, as such, may, of course, vary. It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. It should be appreciated that the term "substantially" is synonymous with terms such as "nearly", "very nearly", "about", "approximately", "around", "bordering on", "close to", "essentially", "in the neighborhood of", "in the vicinity of", etc., and such terms may be used interchangeably as appearing in the specification and claims. Although any methods, devices or materials similar or equivalent to those described herein can be used in the practice or testing of the invention, the preferred methods, devices, and materials are now described.

Figure 1:
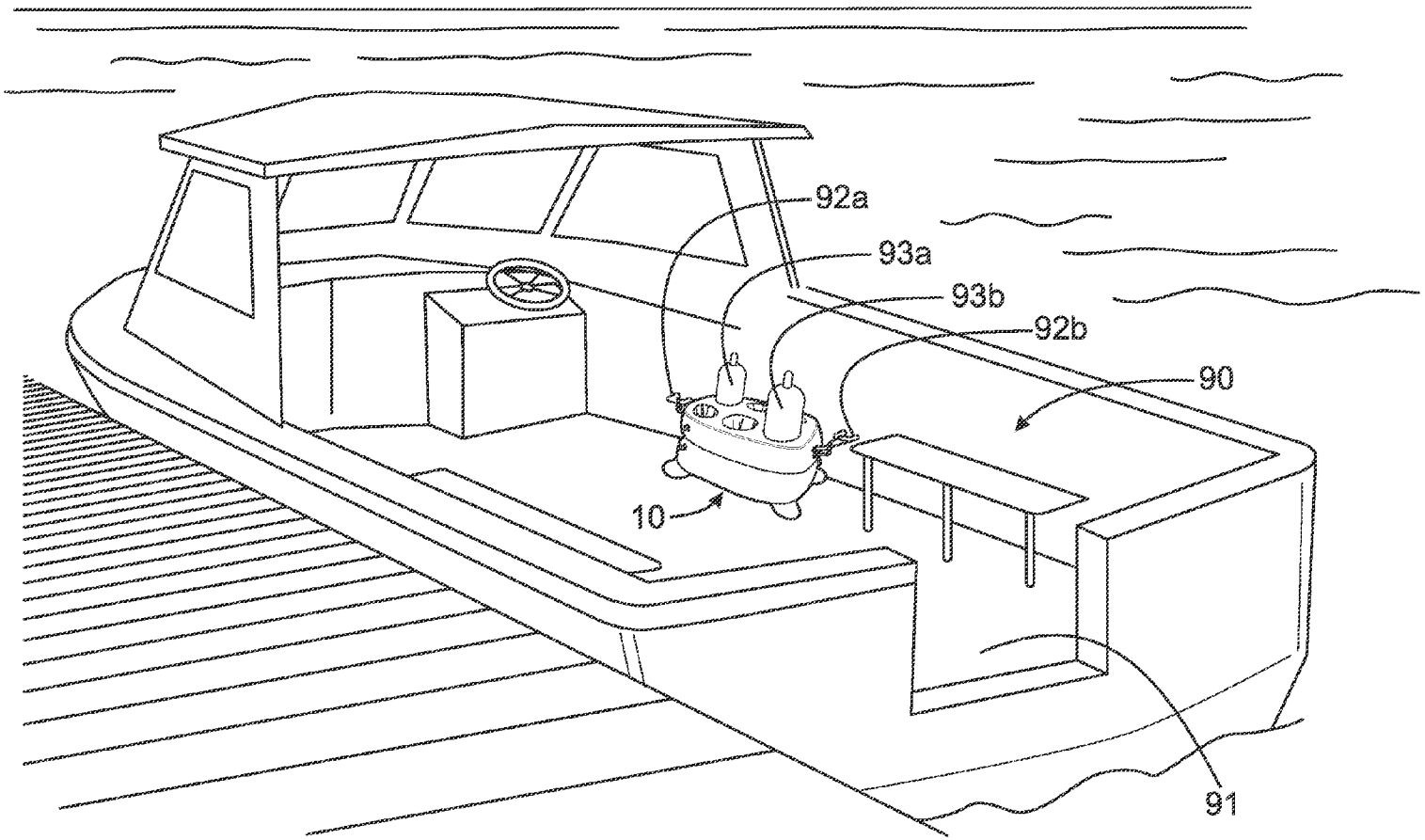
FIG. 1 is a perspective view of an embodiment of the tank storage device of the present invention, shown secured to a boat and holding two dive tanks.
Figure 2:
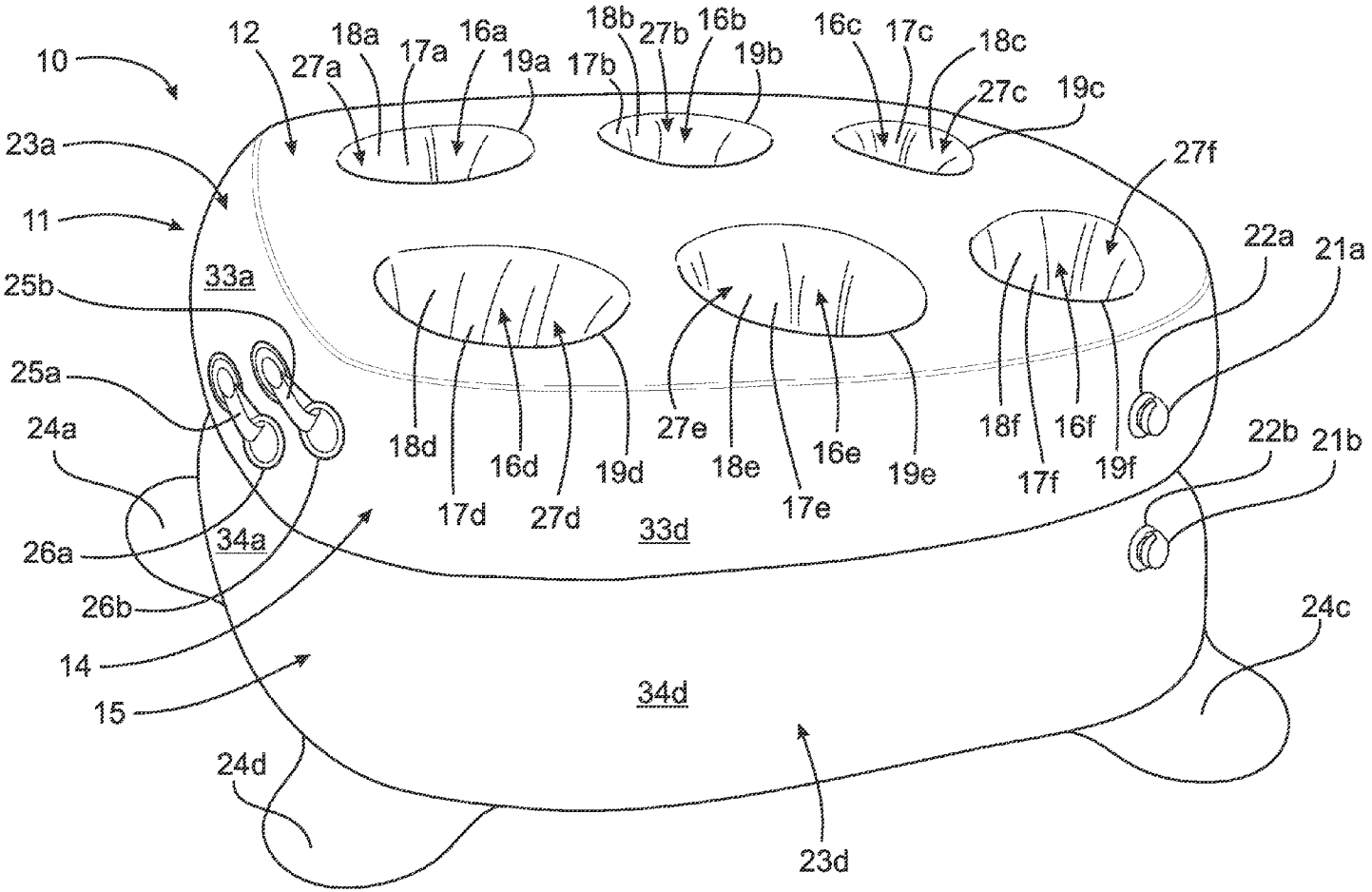
FIG. 2 is a perspective view of the tank storage device of FIG. 1.

Adverting now to the figures, FIG. 1 illustrates one embodiment of the tank storage device of the present invention. FIG. 1 is a perspective view of one embodiment of the tank storage device, hereinafter referred to as device 10. As depicted in FIG. 1, bottom wall 13 (not shown in FIG. 1) of device 10 is adapted to rest upon a substantially horizontal surface, such as boat deck 91, so that dive tanks 93*a*, 93*b* can be safely stored in a substantially upright position. As an additional safety feature, device 10 is shown secured to boat 90 via mounting brackets 92*a*, 92*b*. Handles 26*a-d* (not shown in FIG. 1) can be secured to mounting brackets 92*a*, 92*b* through a variety of means, such as by connecting the handle to the mounting bracket via a rope or a bungee cord.

The following should be viewed in light of FIGS. 1 through 8. The following discussion in directed to device 10; however, it should be understood that the discussion is applicable to device 40 and assembly 50 as well. Generally, device 10 includes inflation valves 21*a*, 21*b*, top wall 12 which includes top openings 16*a-f*, bottom wall 13, side walls 23*a-d* connecting top wall 12 and bottom wall 13, and chamber 11, and plurality of sleeves 18*a-f*. Chamber 11 is at least partially enclosed by top wall 12, bottom wall 13, and plurality of side walls 23*a-d*.

In one embodiment device 10 is substantially rectangular in shape and each top opening 16*a-f* of each sleeve 18*a-f* is substantially oblong or circular in shape. Top wall 12 and bottom wall 13 are diametrically opposed to one another and are connected by four (4) side walls 23*a*, 23*b*, 23*c*, and 23*d*. For example, side wall 23*a* extends upwardly from and substantially perpendicular to bottom wall 13 and extends downwardly from and substantially perpendicular to top wall 12, such that side wall 23*a* intersects both top wall 12 and bottom wall 13 at substantially right angles. Side wall 23*b* extends upwardly from and substantially perpendicular to bottom wall 13 and extends downwardly from and substantially perpendicular to top wall 12, such that side wall 23*b* intersects both top wall 12 and bottom wall 13 at substantially right angles. Side wall 23*c* extends upwardly from and substantially perpendicular to bottom wall 13 and extends downwardly from and substantially perpendicular to top wall 12, such that side wall 23*c* intersects both top wall 12 and bottom wall 13 at substantially right angles. Side wall 23*d* extends upwardly from and substantially perpendicular to bottom wall 13 and extends downwardly from and substantially perpendicular to top wall 12, such that side wall 23*d* intersects both top wall 12 and bottom wall 13 at substantially right angles. Furthermore, side wall 23*a* is adjacent and substantially perpendicular to side wall 23*b* and side wall 23*d*, and diametrically opposed to side wall 23*c*. Side wall 23*b* is adjacent and substantially perpendicular to side wall 23*a* and side wall 23*c*, and diametrically opposed to side wall 23*d*. Side wall 23*c* is adjacent and substantially perpendicular to side wall 23*b* and side wall 23*d*, and diametrically opposed to side wall 23*a*. Side wall 23*d* is adjacent and substantially perpendicular to side wall 23*a* and side wall 23*c*, and diametrically opposed to side wall 23*b*.

Figure 3:
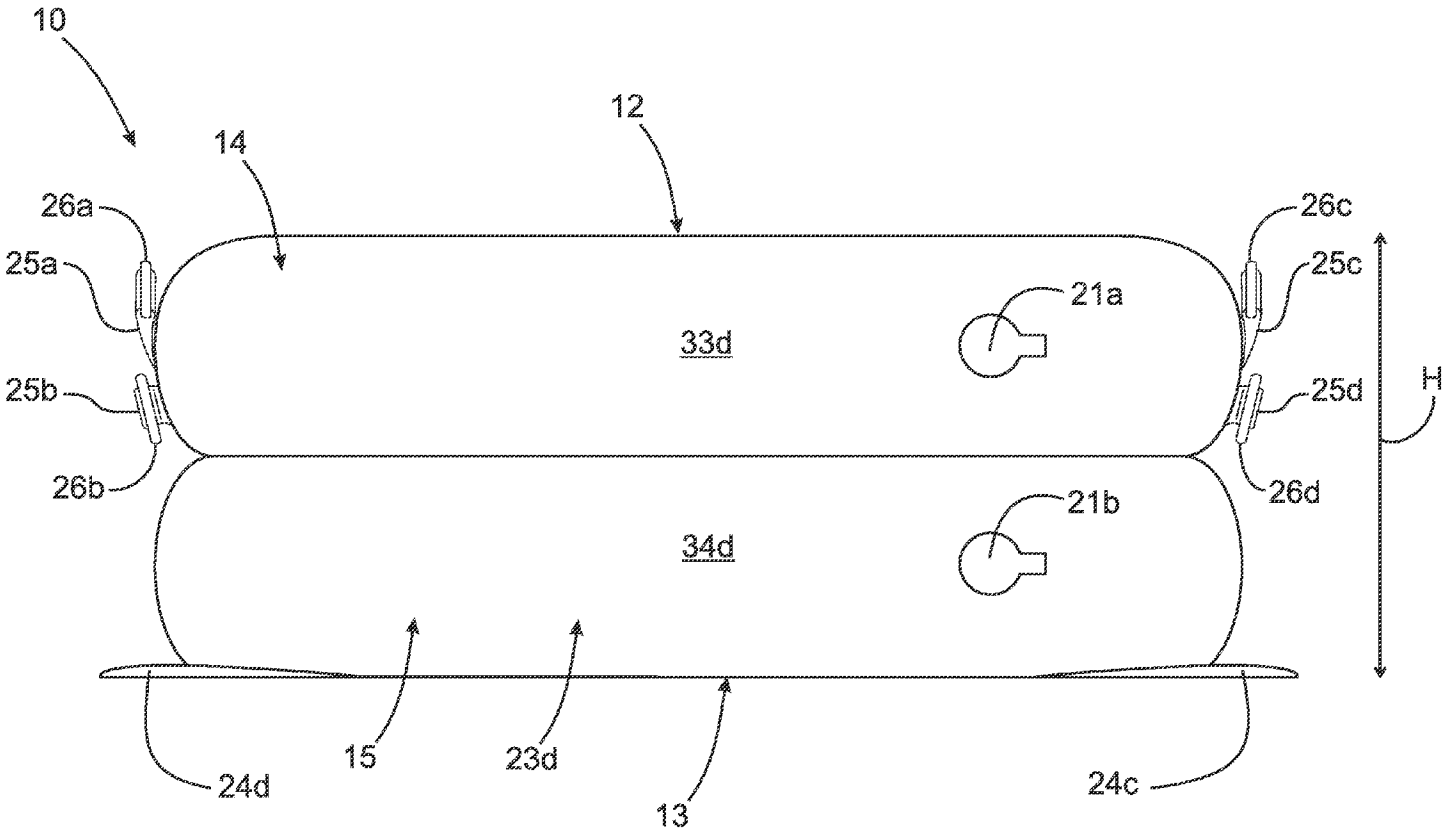
FIG. 3 is a front elevational view of the tank storage device of FIG. 1.
Figure 4:
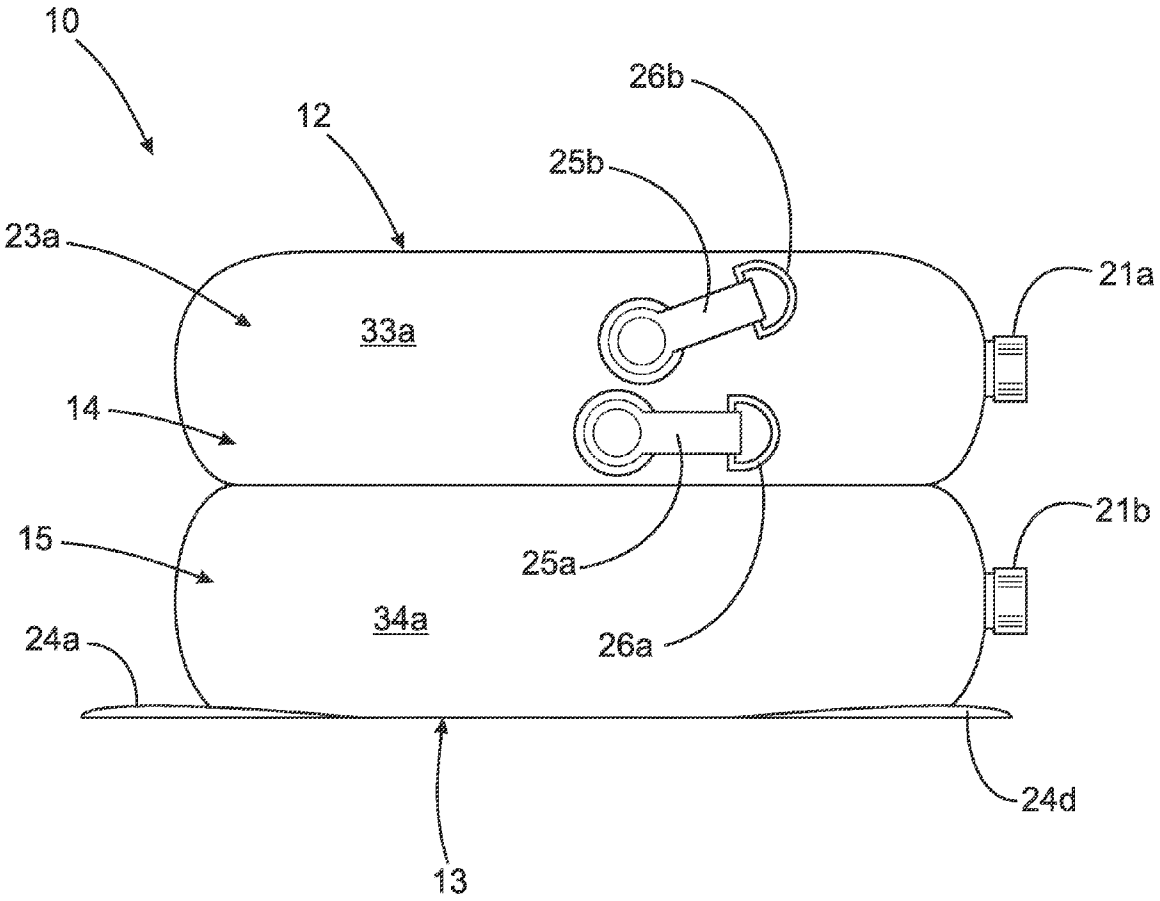
FIG. 4 is a left side elevational view of the tank storage device of FIG. 1.
Figure 5:
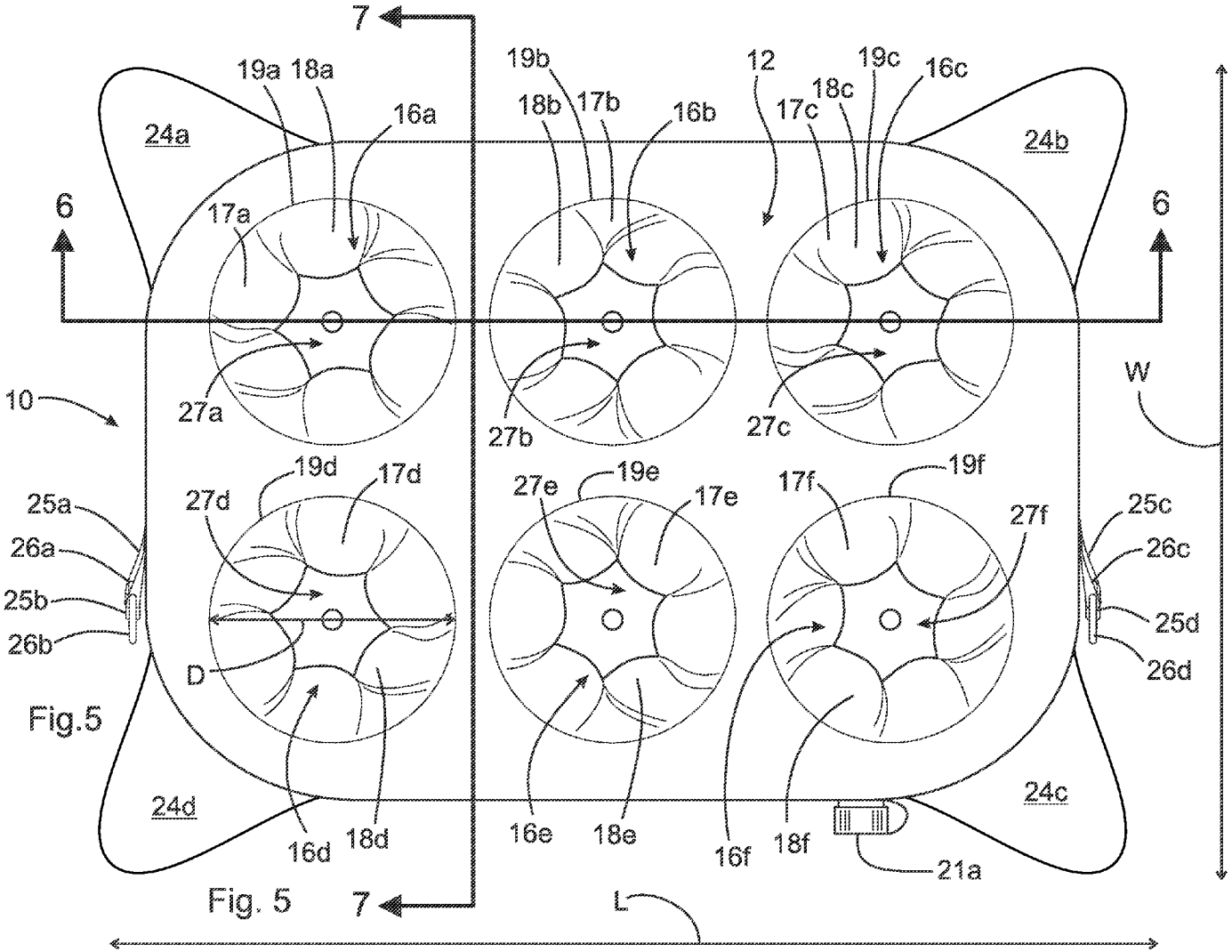
FIG. 5 is top plan view of the tank storage device of FIG. 1.

As shown in FIG. 5, the top opening of each sleeve has diameter D, where diameter D is approximately 24.765 centimeters. As shown in FIGS. 3 and 5, device 10 has length L, width W, and height H. In a preferred embodiment, length L is approximately 90 centimeters, width W is approximately 60 centimeters, and height H is approximately 50 centimeters. However, it should be appreciated that the device can vary in size, shape, and configuration.

Figure 6:
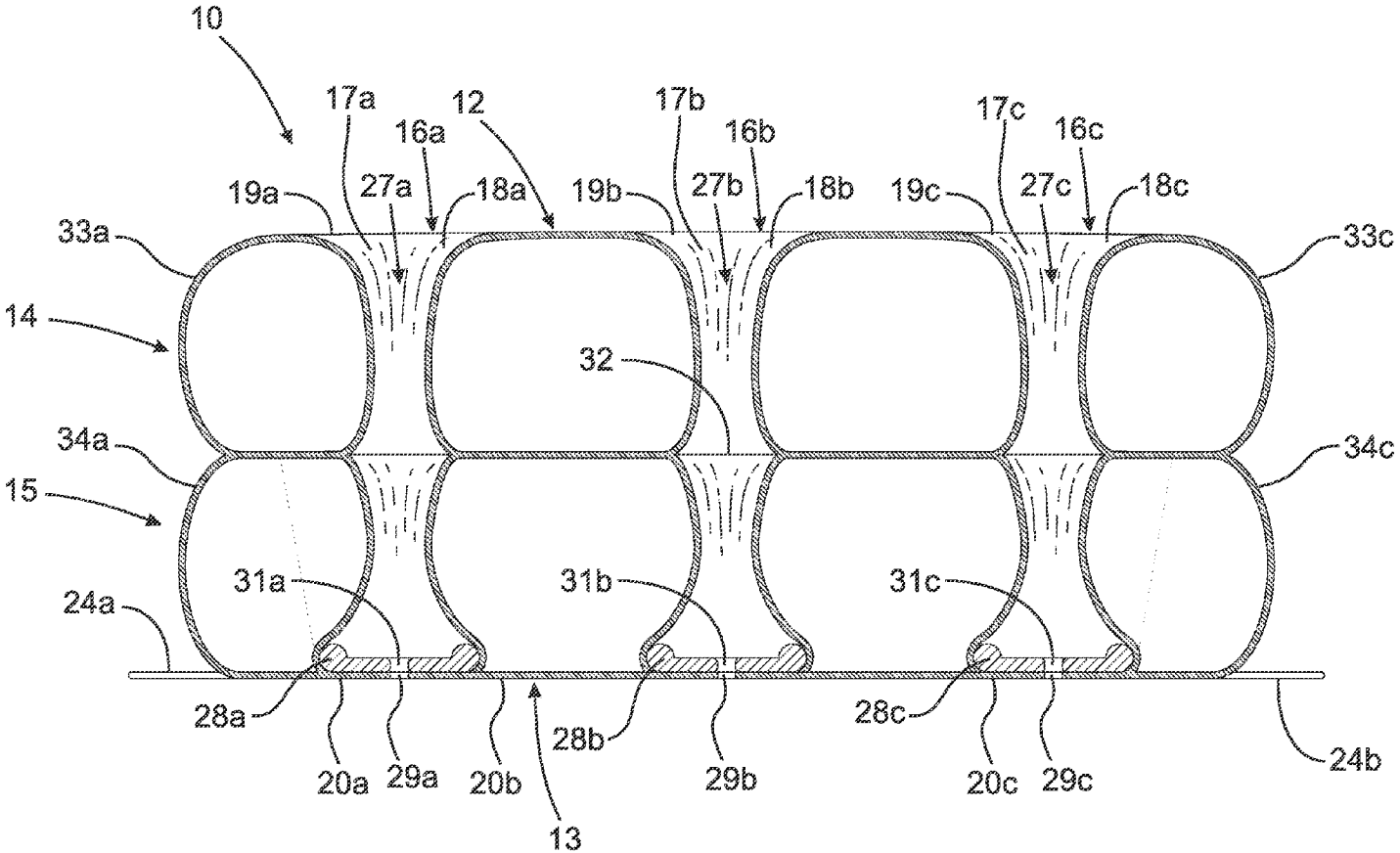
FIG. 6 is a cross-sectional view of the tank storage device, taken generally along line 6-6 of FIG. 5.
Figure 7:
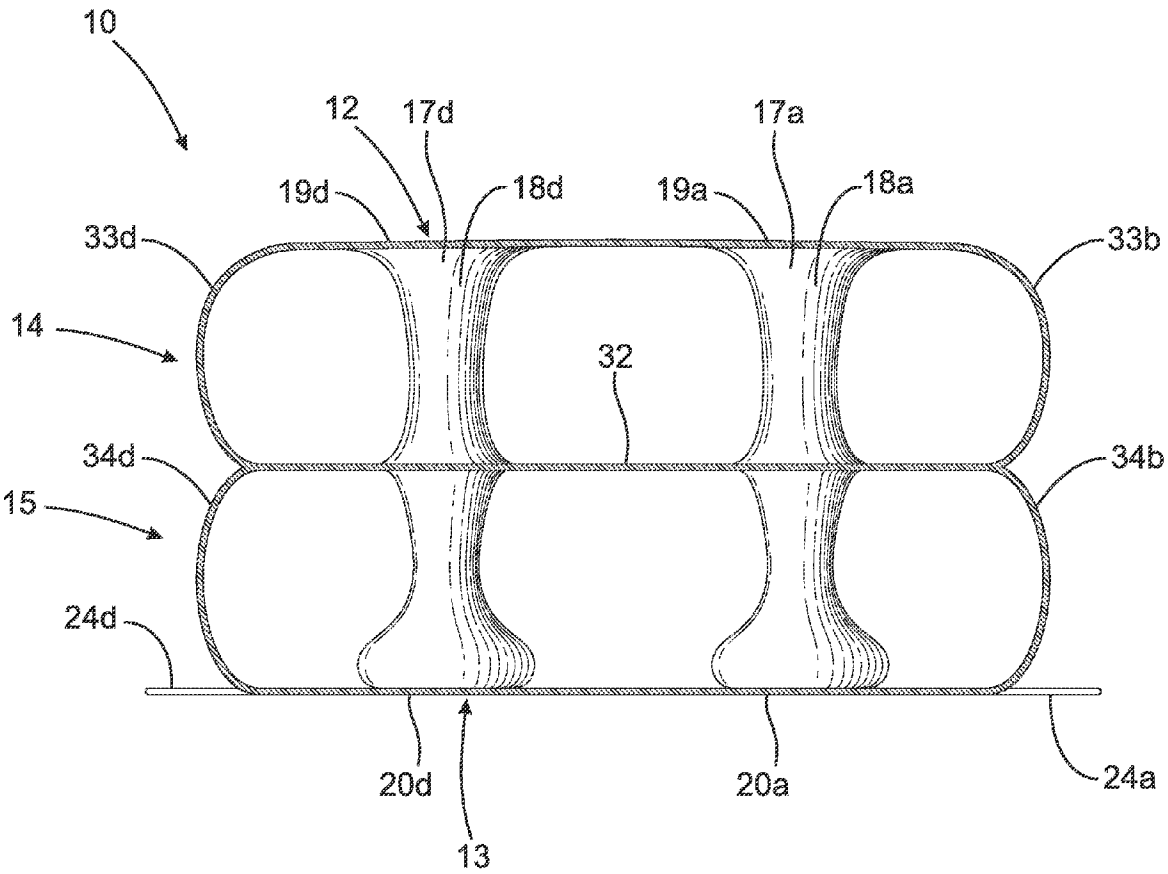
FIG. 7 is a cross-sectional view of the tank storage device, taken generally along line 7-7 of FIG. 5.

As shown in the figures, sleeves 18*a-f* partially enclose chamber 11. In one embodiment, device 10 includes six (6) sleeves 18*a*, 18*b*, 18*c*, 18*d*, 18*e*, and 18*f*. Each sleeve 18*a-f* includes respective top end 19*a-f* bounded by respective top opening 16*a-f*, respective bottom end 20*a-f*, and respective body 17*a-f* connecting top ends 19*a-f* and bottom ends 20*a-f*, respectively, which form respective space 27*a-f* at least partially enclosed by respective body 17*a-f*. It should be appreciated that, preferably, each respective bottom end is integral with the bottom wall and the bottom wall is made of a solid material not capable of inflation with the medium, as depicted in FIGS. 6 and 7.

For example, sleeve 18*a* includes top end 19*a* bounded by top opening 16*a*, bottom end 20*a*, and body 17*a*, which form space 27*a*. Body 17*a* extends upwardly from and substantially perpendicular to bottom end 20*a* and extends downwardly from and substantially perpendicular to top end 19*a*, such that bottom end 20*a* and top end 19*a* are diametrically opposed to one another. Space 27*a* is partially enclosed by body 17*a*, such that space 27*a* is enclosed by bottom end 20*a* and exposed by top opening 16*a*. Sleeve 18*b* includes top end 19*b* bounded by top opening 16*b*, bottom end 20*b*, and body 17*b*, which form space 27*b*. Body 17*b* extends upwardly from and substantially perpendicular to bottom end 20*b* and extends downwardly from and substantially perpendicular to top end 19*b*, such that bottom end 20*b* and top end 19*b* are diametrically opposed to one another. Space 27*b* is partially enclosed by body 17*b*, such that space 27*b* is enclosed by bottom end 20*b* and exposed by top opening 16*b*. Sleeve 18*c* includes top end 19*c* bounded by top opening 16*c*, bottom end 20*c*, and body 17*c*, which form space 27*c*. Body 17*c* extends upwardly from and substantially perpendicular to bottom end 20*c* and extends downwardly from and substantially perpendicular to top end 19*c*, such that bottom end 20*c* and top end 19*c* are diametrically opposed to one another. Space 27*c* is partially enclosed by body 17*c*, such that space 27*c* is enclosed by bottom end 20*c* and exposed by top opening 16*c*. Sleeve 18*d* includes top end 19*d* bounded by top opening 16*d*, bottom end 20*d*, and body 17*d*, which form space 27*d*. Body 17*d* extends upwardly from and substantially perpendicular to bottom end 20*d* and extends downwardly from and substantially perpendicular to top end 19*d*, such that bottom end 20*d* and top end 19*d* are diametrically opposed to one another. Space 27*d* is partially enclosed by body 17*d*, such that space 27*d* is enclosed by bottom end 20*d* and exposed by top opening 16*d*. Sleeve 18*e* includes top end 19*e* bounded by top opening 16*e*, bottom end 20*e*, and body 17*e*, which form space 27*e*. Body 17*e* extends upwardly from and substantially perpendicular to bottom end 20*e* and extends downwardly from and substantially perpendicular to top end 19*e*, such that bottom end 20*e* and top end 19*e* are diametrically opposed to one another. Space 27*e* is partially enclosed by body 17*e*, such that space 27*e* is enclosed by bottom end 20*e* and exposed by top opening 16*e*. Sleeve 18*f* includes top end 19*f* bounded by top opening 16*f*, bottom end 20*f*, and body 17*f*, which form space 27*f*. Body 17*f* extends upwardly from and substantially perpendicular to bottom end 20*f* and extends downwardly from and substantially perpendicular to top end 19*f*, such that bottom end 20*f* and top end 19*f* are diametrically opposed to one another. Space 27*f* is partially enclosed by body 17*f*, such that space 27*f* is enclosed by bottom end 20*f* and exposed by top opening 16*f*.

In one embodiment chamber 11 includes first airtight chamber 14 and second airtight chamber 15. As shown in FIGS. 6 and 7, common wall 32 is substantially parallel to and connects first chamber 14 and second chamber 15. First chamber 14 includes top wall 12 and second chamber 15 includes bottom wall 13. Each sleeve 18*a-f* is partially disposed in both first chamber 14 and second chamber 15. Additionally, first chamber 14 includes first portion 33*a-d* of side walls 23*a-d*, respectively, and second chamber 15 includes second portion 34*a-d* of side walls 23*a-d*, respectively. First chamber 14 is enclosed by top wall 12, first portion 33*a-d* of side walls 23*a-d*, common wall 32, and respective first portions of sleeves 18*a-f* including respective top openings 16*a-f*. Second chamber 15 is enclosed by bottom wall 13, second portion 34*a-d* of side walls 23*a-d*, common wall 32, and respective second portions of sleeves 18*a-f* including respective bottom ends 20*a-f*.

Furthermore, first portion 33*a* is adjacent and substantially perpendicular to first portion 33*b* and first portion 33*d*, and diametrically opposed to first portion 33*c*. First portion 33*b* is adjacent and substantially perpendicular to first portion 33*a* and first portion 33*c*, and diametrically opposed to first portion 33*d*. First portion 33*c* is adjacent and substantially perpendicular to first portion 33*b* and first portion 33*d*, and diametrically opposed to first portion 33*a*. First portion 33*d* is adjacent and substantially perpendicular to first portion 33*b* and first portion 33*d*, and diametrically opposed to first portion 33*b*. Similarly, second portion 34*a* is adjacent and substantially perpendicular to second portion 34*b* and second portion 34*d*, and diametrically opposed to second portion 34*c*. Second portion 34*b* is adjacent and substantially perpendicular to second portion 34*a* and second portion 34*c*, and diametrically opposed to second portion 34*d*. Second portion 34*c* is adjacent and substantially perpendicular to second portion 34*b* and second portion 34*d*, and diametrically opposed to second portion 34*a*. Second portion 34*d* is adjacent and substantially perpendicular to second portion 34*b* and second portion 34*d*, and diametrically opposed to second portion 34*b*.

Inflation valves 21*a*, 21*b* are arranged to introduce a medium into airtight chambers 14, 15, respectively, to inflate device 10. First inflation valve 21*a* is affixed via first attachment means 22*a* to first portion 33*d* of side wall 23*d*, such that first inflation valve 21*a* is disposed substantially perpendicular to first portion 33*d* of side wall 23*d*. A pressurized medium is introduced into first inflation valve 21*a* to inflate first airtight chamber 14. Second inflation valve 21*b* is affixed via second attachment means 22*b* to second portion 34*d* of side wall 23*d*, such that second inflation valve 21*b* is disposed substantially perpendicular to second portion 34*d* of side wall 23*d*. A pressurized medium is introduced into second inflation valve 21*b* to inflate second airtight chamber 15.

In one embodiment, side wall 23*a* includes straps 25*a*, 25*b* and handles 26*a*, 26*b*, respectively, and side wall 23*c* includes straps 25*c*, 25*d* and handles 26*c*, 26*d*, respectively. Straps 25*a*, 25*b* are disposed substantially parallel to first portion 33*a* of side wall 23*a*. Strap 25*b* extends outwardly from first portion 33*a* and slants upwardly at approximately a 35-degree angle, whereas strap 25*a* extends outwardly from first portion 33*a* and continues such that strap 25*a* is substantially parallel with the horizontal surface upon which the device rests. Straps 25*c*, 25*d* are disposed substantially parallel to first portion 33*c* of side wall 23*c*. Strap 25*d* extends outwardly from first portion 33*c* and slants upwardly at approximately a 35-degree angle, whereas strap 25*c* extends outwardly from first portion 33*c* and continues such that strap 25*c* is substantially parallel with the horizontal surface upon which the device rests. Handles 26*a*, 26*b* are secured to straps 25*a*, 25*b*, respectively, and handles 26*c*, 26*d* are secured to straps 25*c*, 25*d*, respectively. It should be understood that the straps can be mounted to the device by any suitable means known in the art, as well as the handles can be secured to the straps by any suitable means known in the art.

In order to store and transport the dive tanks, individual dive tanks, as shown in FIG. 1, are inserted via corresponding top openings into respective spaces within each sleeve, when the device is inflated. Each sleeve accommodates a single dive tank. It should be appreciated that while each sleeve is preferably arranged to hold a dive tank, it may support any type of tank, such as a helium tank, a propane tank, an air storage tanks, etc., or any tank known in the art. The body of each sleeve surrounds the dive tank in order to hold the tank in a substantially upright position within each space. Additionally, the bottom end of each sleeve is arranged to support the respective dive tank. Furthermore, bottom wall 13 includes foot tabs 24*a-d*. Each foot tab 24*a-d* is disposed substantially planar to and extending outwardly from a respective corner of bottom wall 13. Each foot tab is provided so that a user can step on one of the foot tabs depending on the location of the dive tanks within the sleeves, and hold down the device, while pulling upwardly on the dive tank to remove it from the sleeve.

Figure 8:
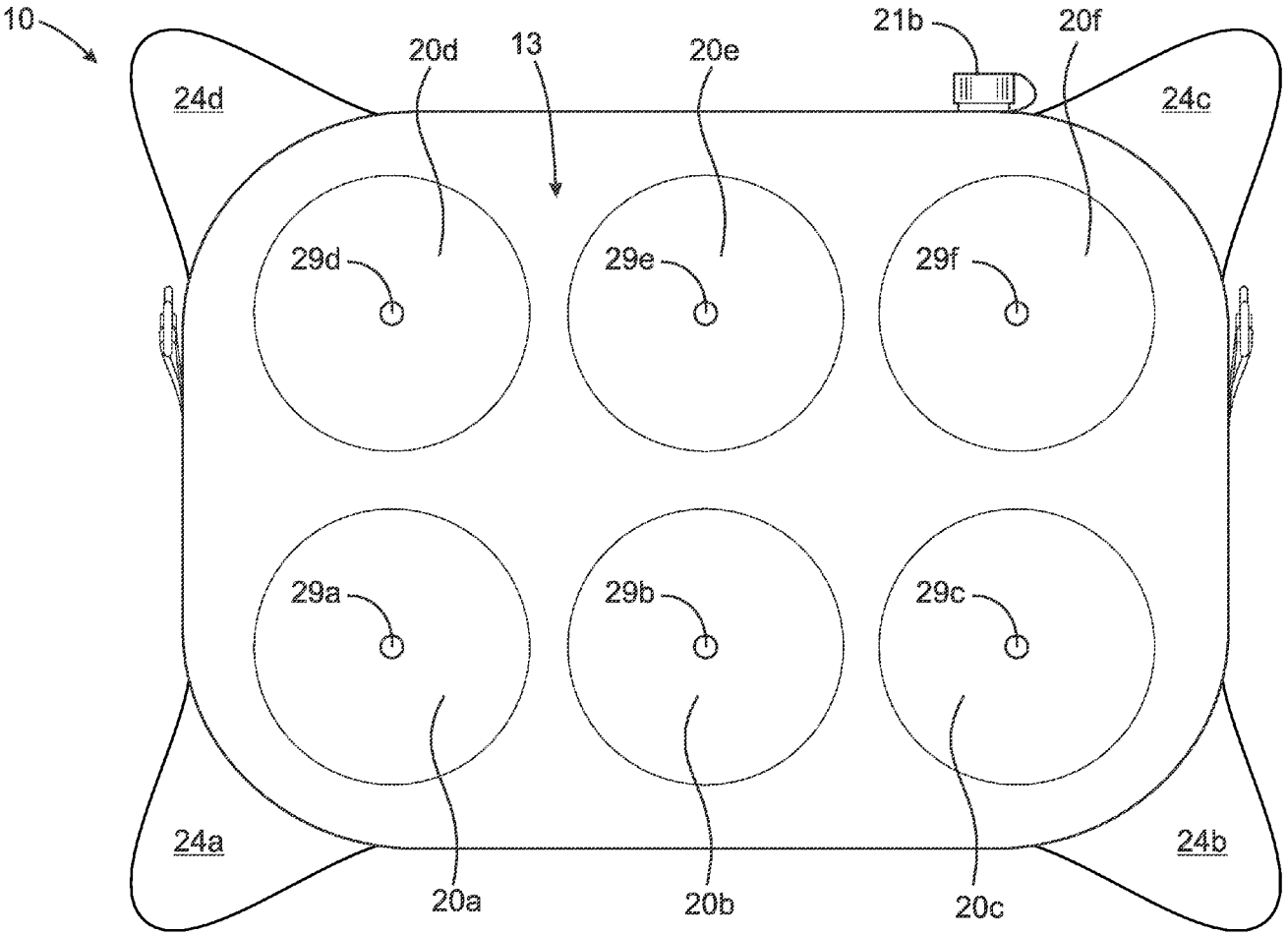
FIG. 8 is bottom plan view of the tank storage device of FIG. 1.

As shown in FIGS. 6 and 8, each bottom end 20*a-f* of each sleeve 18*a-f*, further includes drainage apertures 29*a-f*, respectively. For example, drainage aperture 29*a* is located proximate to the center of bottom end 20*a*. Drainage aperture 29*b* is located proximate to the center of bottom end 20*b*. Drainage aperture 29*c* is located proximate to the center of bottom end 20*c*. Drainage aperture 29*d* is located proximate to the center of bottom end 20*d*. Drainage aperture 29*e* is located proximate to the center of bottom end 20*e*. Drainage aperture 29*f* is located proximate to the center of bottom end 20*f*. Optionally, each sleeve 18*a-f* includes respective insert 28*a-f* disposed within respective space 27*a-f* proximate to bottom end 20*a-f* of each respective sleeve 18*a-f*. For example, insert 28*a* is disposed within space 27*a* proximate to bottom end 20*a*. Insert 28*b* is disposed within space 27*b* proximate to bottom end 20*b*. Insert 28*c* is disposed within space 27*c* proximate to bottom end 20*c*. Insert 28*d* is disposed within space 27*d* proximate to bottom end 20*d*. Insert 28*e* is disposed within space 27*e* proximate to bottom end 20*e*. Insert 28*f* is disposed within space 27*f* proximate to bottom end 20*f*. Moreover, each insert 28*a-f* includes respective insert aperture 31*a-f*, where each insert aperture corresponds with a drainage aperture to permit water or other fluids to easily drain out of the respective sleeve. In one embodiment, the inserts may be inflatable and made of a PVC material similar to the device. In another embodiment, the inserts may be made of a foam material. However, it should be appreciated that the inserts can be made of any suitable material known in the art and can vary in size and shape. The inserts are included to protect the respective bottom ends from wearing due to the constant insertion and removal of a dive tank.

Figure 9:
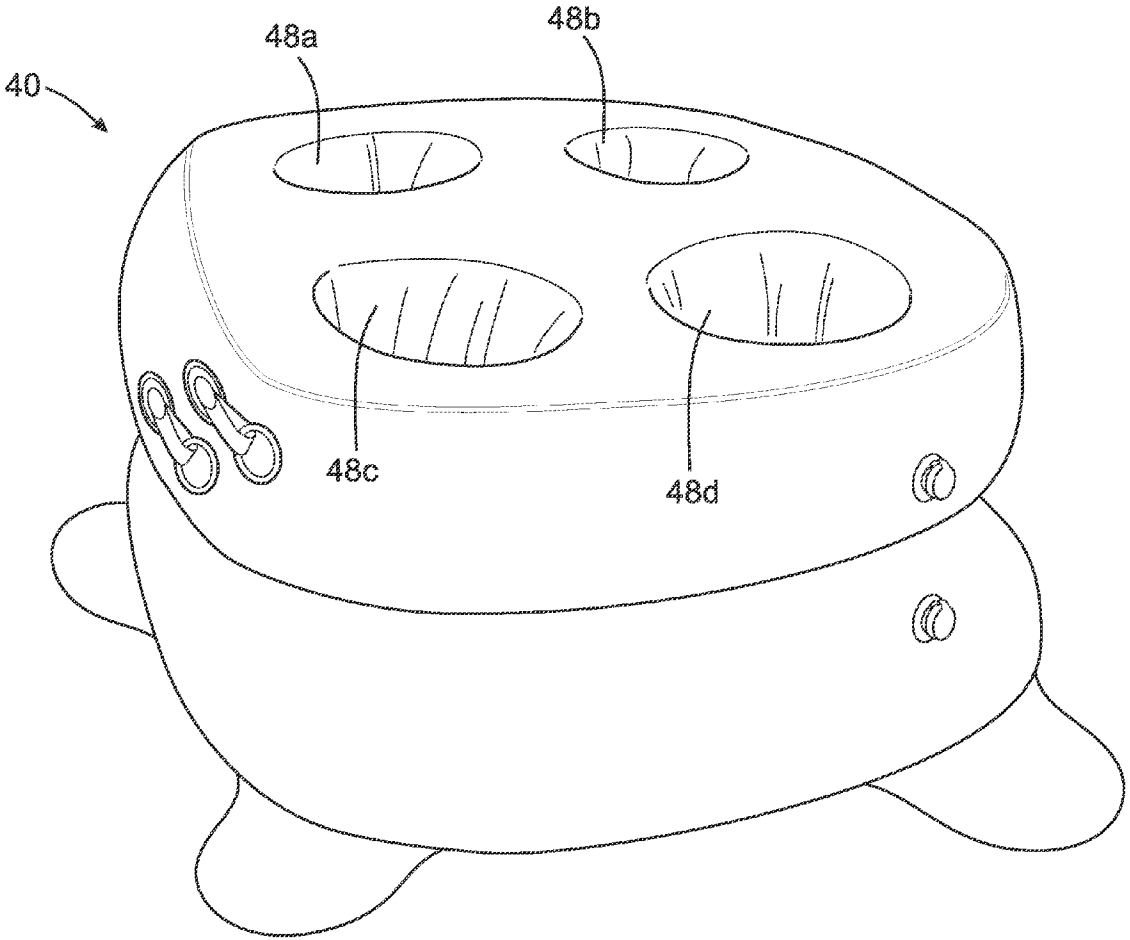
FIG. 9 is a perspective view of another embodiment of the tank storage device, depicting four sleeves; and, FIG. 10 is a perspective view of yet another embodiment of the tank storage device, showing an assembly including a plurality of modules connected to one another via interlocking teeth.

FIG. 9 illustrates another embodiment of the present invention, similar to the embodiment of device 10. In this embodiment, device 40 is shown having four (4) sleeves 48*a-d* as opposed to six (6) sleeves, as shown in the embodiment of the device in FIGS. 1 through 8. It should be understood that devices 10, 40 are not limited to a particular quantity of sleeves and that other numbers of sleeves, other than those shown in the figures of the present disclosure, are possible.

Figure 10:
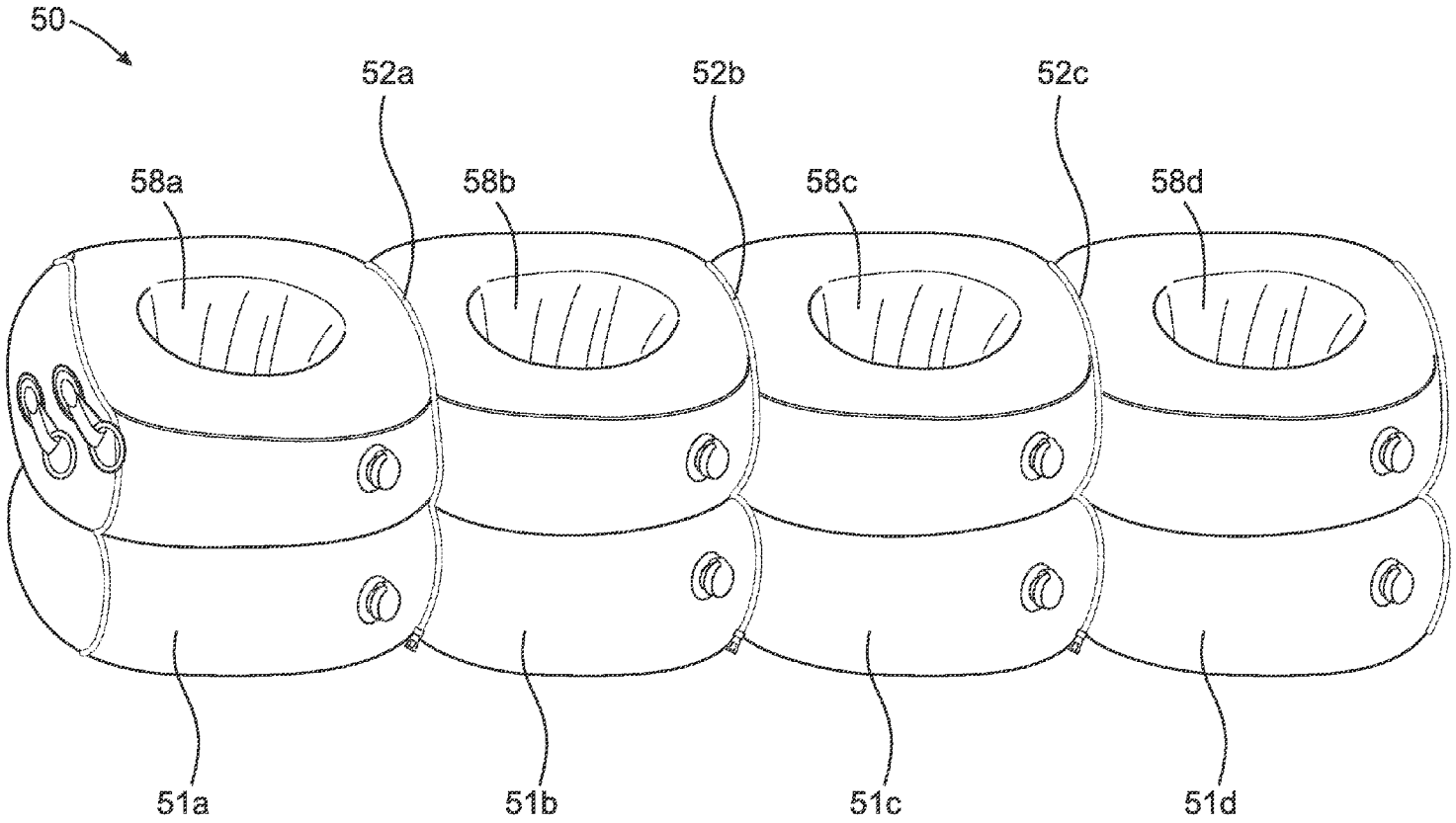

FIG. 10 is a perspective view of yet another embodiment of the tank storage device, showing assembly 50 having plurality of modules 51*a-d* secured to one another via a zipper. Each module 51*a-d* includes a single sleeve 58*a-d*, respectively. Each module 51*a-d* further includes a plurality of teeth, where the plurality of teeth is disposed along the surface of at least one side wall, such that when a first module is paired with a second module, the plurality of teeth on each corresponding module interlock to form a zipper 52*a*-52*c*. For example, module 51*a* is connected to module 51*b* via zipper 52*a*, module 51*b* is connected to module 51*c* via zipper 52*b*, and module 51*c* is connected to module 51*d* via zipper 52*c*.

Devices 10, 40, and assembly 50 can be made of any suitable material known in the art, including, but not limited to plastic, such as polyvinyl chloride (PVC), and more particularly, 1,100 decitex PVC material. In a preferred embodiment, the PVC material is approximately 0.75 millimeters thick. However, it should be appreciated that the device or assembly can be made of any suitable material known in the art and be any thickness.

Thus, it is seen that the objects of the present invention are efficiently obtained, although modifications and changes to the invention should be readily apparent to those having ordinary skill in the art, which modifications are intended to be within the spirit and scope of the invention as claimed. It also is understood that the foregoing description is illustrative of the present invention and should not be considered as limiting. Therefore, other embodiments of the present invention are possible without departing from the spirit and scope of the present invention.

What is claimed is:

1. A device for holding tanks, comprising:

at least two inflation valves;

a top wall including at least one top opening;

a bottom wall;

a common wall;

a plurality of side walls connecting the top and bottom walls;

at least two chambers at least partially enclosed by the top, bottom, common, and side walls, wherein each chamber includes at least one of the at least two inflation valves; and, a plurality of sleeves, each sleeve including:
a respective top end bounded by a respective top opening;
a respective bottom end; and,
a respective body connecting the top and bottom ends and forming a respective space at least partially enclosed by the respective body, wherein:
each of the at least two inflation valves are arranged to introduce into each of the at least two chambers a medium to inflate the device; and,
when the device is inflated:
the respective space is arranged to receive and hold a respective tank; and,
the respective bottom end is arranged to support the respective tank, wherein the respective bottom end is integral with the bottom wall and the bottom wall is comprised of a solid material not capable of inflation with the medium and the at least two chambers are capable of inflation with the medium.

2. The device of claim 1, wherein the plurality of sleeves partially encloses the at least two chambers.

3. The device of claim 1, wherein the respective bottom end is substantially the same size as the respective top opening.

4. The device of claim 1, wherein the respective bottom end is smaller than the respective top opening.

5. The device of claim 1, wherein:
the at least two chambers includes first and second airtight chambers with a common wall connecting the first and second airtight chambers;
the at least two inflation valves includes first and second inflation valves for the first and second airtight chambers, respectively;
the first airtight chamber includes the top wall;
the second airtight chamber includes the bottom wall; and,
the plurality of sleeves is partially disposed in each of the first and second airtight chambers.

6. The device of claim 5, wherein:
the first airtight chamber includes a first portion of the plurality of side walls; and,
the second airtight chamber includes a second portion of the plurality of side walls.

7. The device of claim 6, wherein:
the first airtight chamber is enclosed by the top wall, the first portion of the plurality of side walls, the common wall, and respective first portions of the plurality of sleeves including the respective top openings; and,
the second airtight chamber is enclosed by the bottom wall, the second portion of the plurality of side walls, the common wall, and respective second portions of the plurality of sleeves including the respective bottom ends.

8. The device of claim 1, wherein the bottom end of each sleeve further comprises at least one drainage aperture.

9. The device of claim 1, wherein at least one of the plurality of side walls includes a handle.

10. The device of claim 1, wherein the device is substantially rectangular in shape.

11. The device of claim 1, wherein the top opening of each sleeve is substantially oblong in shape.

12. The device of claim 1, wherein the top opening of each sleeve is substantially circular in shape.

13. The device of claim 1, wherein the top opening of each sleeve has a diameter D, wherein diameter D is approximately 24.765 centimeters.

14. The device of claim 1, has a length L, a width W, and a height H, wherein the length L is approximately 90 centimeters, the width W is approximately 60 centimeters, and the height H is approximately 50 centimeters.

15. The device of claim 1, wherein the device is made of a polyvinyl chloride (PVC) material.

16. The device of claim 15, wherein the device is made of 1,100 decitex PVC material.

17. The device of claim 1, wherein each sleeve further comprises an insert disposed within the space proximate to the bottom end of each sleeve.

18. The device of claim 1, wherein the bottom wall includes at least one foot tab extending outwardly therefrom.

19. An assembly for holding tanks, comprising:
at least two modules, each module including:
at least one inflation valve;
a top wall including a plurality of top openings;
a bottom wall;
a common wall;
a plurality of side walls connecting the top and bottom walls;
at least one chamber at least partially enclosed by the top, bottom, and side walls;
a plurality of sleeves, each sleeve including:
a respective top end bounded by a respective top opening;
a respective bottom end; and,
a respective body connecting the top and bottom ends and forming a respective space at least partially enclosed by the respective body, wherein:
the at least one inflation valve is arranged to introduce into the at least one chamber a medium to inflate the device; and,
when the device is inflated:
the respective space is arranged to receive and hold a respective tank;
the respective bottom end is arranged to support the respective tank, wherein the respective bottom end is integral with the bottom wall and the bottom wall is comprised of a solid material not capable of inflation with the medium and the at least one chamber is capable of inflation with the medium; and,
a plurality of teeth, wherein the plurality of teeth is disposed along the surface of at least one side wall, such that when a first module is paired with a second module, the plurality of teeth on each corresponding module interlock.

20. The device of claim 19, wherein the plurality of teeth on each corresponding module interlock to form a zipper.

* * * * *